US006296307B1

(12) United States Patent
Holtke

(10) Patent No.: US 6,296,307 B1
(45) Date of Patent: Oct. 2, 2001

(54) REVERSIBLE SEAT PAD

(75) Inventor: Timothy D. Holtke, Green Bay, WI (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/440,835

(22) Filed: Nov. 15, 1999

(51) Int. Cl.[7] ..... A47C 31/00

(52) U.S. Cl. ..... 297/219.12; 297/250.1; 297/218.3

(58) Field of Search ..... 297/219.12, 219.1, 297/228.13, 228.12, 218.3, 218.5, 250.1

(56) References Cited

U.S. PATENT DOCUMENTS 4,457,032 7/1984 Clarke .
4,773,702 9/1988 Takahashi et al. .
4,969,683 * 11/1990 Wallace et al. ..... 297/219.1
5,005,903 4/1991 Minardi .
5,366,271 * 11/1994 Johnston et al. ..... 297/250.1 X
5,860,696 1/1999 Opsvik et al. .
6,089,659 * 7/2000 Toyota ..... 297/228.12

* cited by examiner

*Primary Examiner*—Anthony D. Barfield
(74) *Attorney, Agent, or Firm*—Barnes & Thornburg

(57) ABSTRACT

A seat unit including a seat, a reversible seat pad, and a primary first tether strap. The seat includes a forward side and an opposite rearward side and is formed to include a first tether slot. The reversible seat pad is formed to include a first strap passage slot therein. The primary first tether strap is arranged to extend through the first tether slot and includes a fixed end coupled to the reversible seat pad and a free end coupled to the seat on the rearward side thereof. The free end is adapted to be passed through the first strap passage slot formed in the reversible seat pad and the first tether slot formed in the seat.

41 Claims, 4 Drawing Sheets

REVERSIBLE SEAT PAD

BACKGROUND AND SUMMARY OF THE INVENTION

The present invention relates to a seat pad for use on a seat, and particularly to a seat pad to be mounted on a juvenile seat such as a high chair. More particularly, the present invention relates to a seat pad that is reversible so that it can be mounted on a juvenile seat in either a first position where its front face is visible or a reversed second position where its back face is visible.

It is common to place a pad on a seat to provide comfort to an occupant of the seat. Seat pads are disclosed, for example, in U.S. Pat. Nos. 5,806,696; 5,005,903; 4,773,702; and 4,457,032, the disclosures of which are incorporated by reference herein.

According to the present invention, a seat unit includes a seat and a reversible seat pad to be mounted on the seat in either a first position or a reversed second position The seat unit also includes a tether strap having a fixed end coupled to the reversible seat pad and a free end that is movable so that it can be coupled to the seat to tether the reversible seat pad to the seat whether the pad is in its first or second position on the seat. The reversible seat pad is formed to include a strap passage slot and the free end of the tether strap is adapted to be passed by a user back and forth through the strap passage slot during reversal of the seat pad so that the user can couple the tether strap to the seat whether the pad is in its first or second position on the seat.

In preferred embodiments, the seat unit includes four tether straps that are used to tether a middle portion of the reversible seat pad to the seat regardless of the position of the reversible seat pad on the seat. The reversible seat pad includes a rear face that contacts the seat when the seat pad is moved to assume its first position and a front face that contacts the seat when the seat pad is moved to assume its second position. Because of the reversible character of the seat pad, an occupant of the seat will sit on the front face when the seat pad is in its first position and the rear face when the seat pad is in its second position.

The reversible seat pad is formed to include two strap passage slots and these slots are arranged to lie in spaced-apart relation to one another along a fold line between a pad back and pad bottom included in the reversible seat pad. The fixed ends of a first pair of tether straps are coupled to the reversible seat pad along edges defining the first strap passage slot and the fixed ends of a second pair of tether straps are coupled to the reversible seat pad along edges defining the second strap passage slot.

The seat is formed to include two tether slots and these tether slots are arranged to lie in spaced-apart relation to one another along a junction line between the back and bottom of the seat. The first tether slot aligns with the first strap passage slot whenever the reversible seat pad is placed on the seat so that a user can pass the free ends of the first pair of tether straps through the first tether slot and couple those free ends to a first tether mount provided on the rearward side of the seat. Also, the second tether slot aligns with the second strap passage whenever the reversible seat pad is placed on the seat so that a user can pass the free ends of the second pair of tether straps through the second tether slot and couple those free ends to a second tether mount provided on the rearward side of the seat.

While the four tether straps serve to tether a "middle" portion of the reversible seat pad to the seat regardless of whether the seat pad is placed in its first position or reversed second position on the seat, the reversible seat pad is also formed to include holes which receive pad mounts coupled to the seat to retain the pad back and pad bottom on the seat whether the seat pad has been placed in its first position or reversed second position on the seat. Three top pad mounts are coupled to the rearward face of the seat near a top edge of the seat back and arranged to extend into three mount-receiver holes formed in an upper portion of the seat pad that has been wrapped over the top edge of the seat back. Several bottom pad mounts are coupled to the rearward face of the seat near a leading edge of the seat bottom and arranged to extend into mount-receiver holes formed in a lower portion of the seat pad that has been wrapped under the leading edge of the seat bottom.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
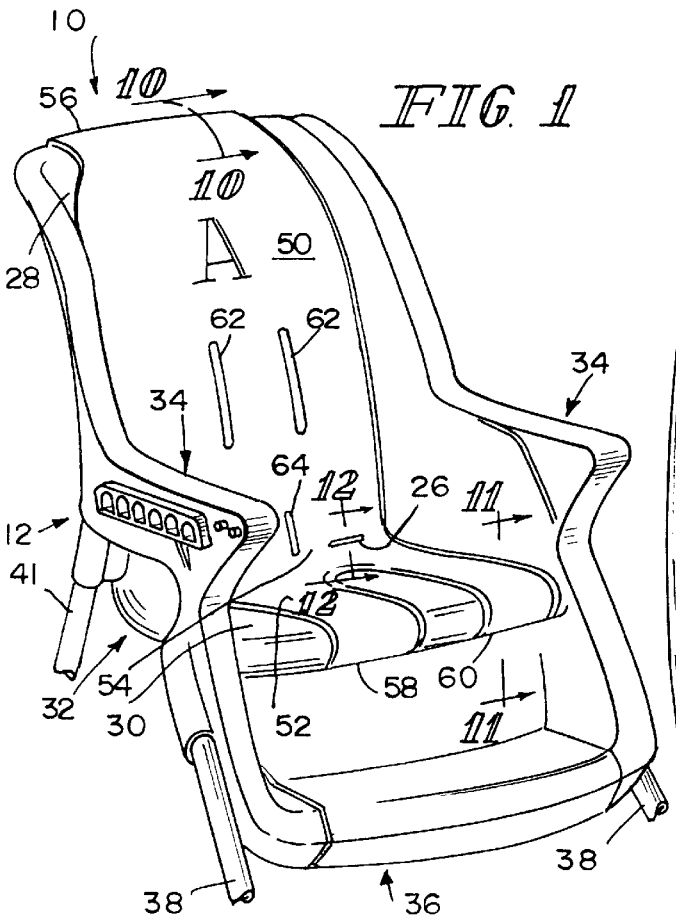
FIG. 1 is a perspective view of a reversible seat pad in accordance with the preset invention mounted on a seat so that side "A" is visible.
Figure 4:
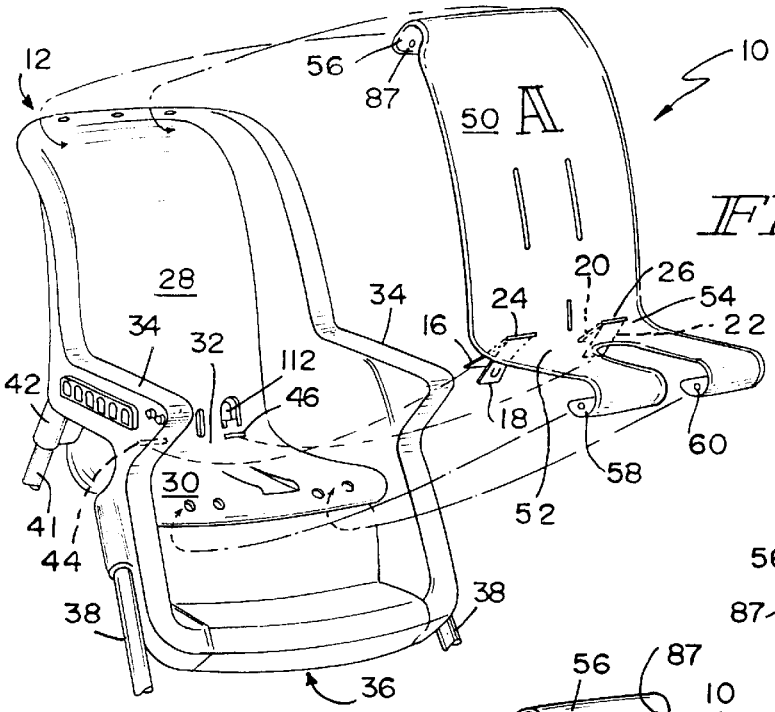
FIG. 4 is a perspective view showing how the reversible seat pad of FIG. 3 can be installed on the seat of FIG. 2 so that side A is visible.
Figure 6:
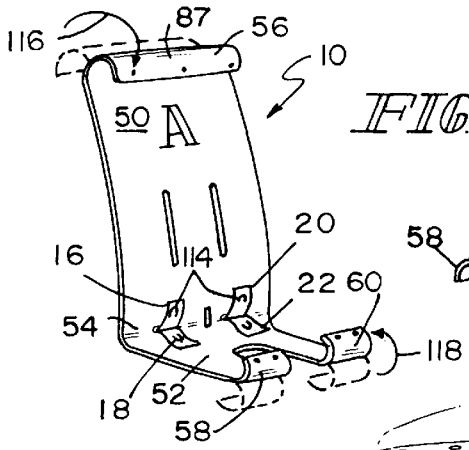
FIGS. 6–8 show how the reversible seat pad can be manipulated by a user so that it can be "reversed" from the first position shown in FIG. 4 to the second position shown in FIG. 9.

A reversible seat pad 10 is adaptable to be mounted in a first position on a seat 12 so that a front side "A" of pad 10 is visible as shown in FIGS. 1 and 4. To "reverse" seat pad 10, it is necessary only to uncouple seat pad 10 from seat 12 as shown in FIG. 4, fold seat pad 10 to assume a "reversed" configuration as shown, for example, in FIGS. 6 and 7, rotate seat pad 10 about a vertical axis 14, and remount seat pad 10 in a second position on seat 12 so that a back side "B" of pad 10 is now visible as shown in FIG. 9.

Figure 3:
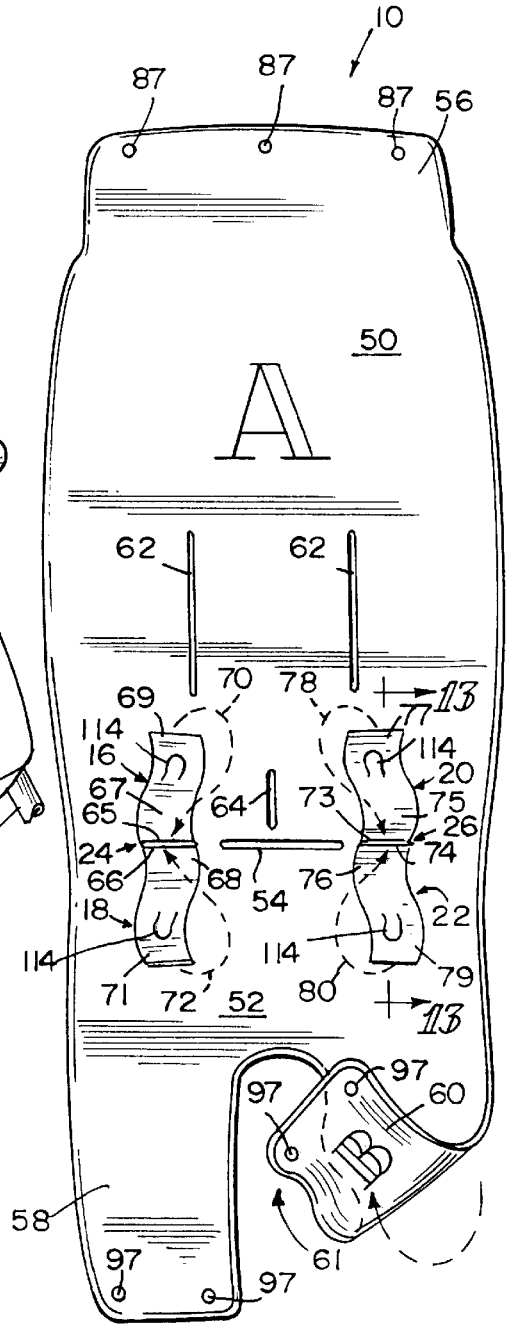
FIG. 3 is a plan view of the reversible seat pad prior to installation on the seat s owing three top pad mount-receiver holds along a top edge, two sets of two bottom pad mount-receiver holes along a bottom edge, first and second strap passage slots along a middle fold line, a first set of two tether straps associated with the first strap passage slot, and a second set of two tether straps associated with the second strap passage slot.
Figure 9:
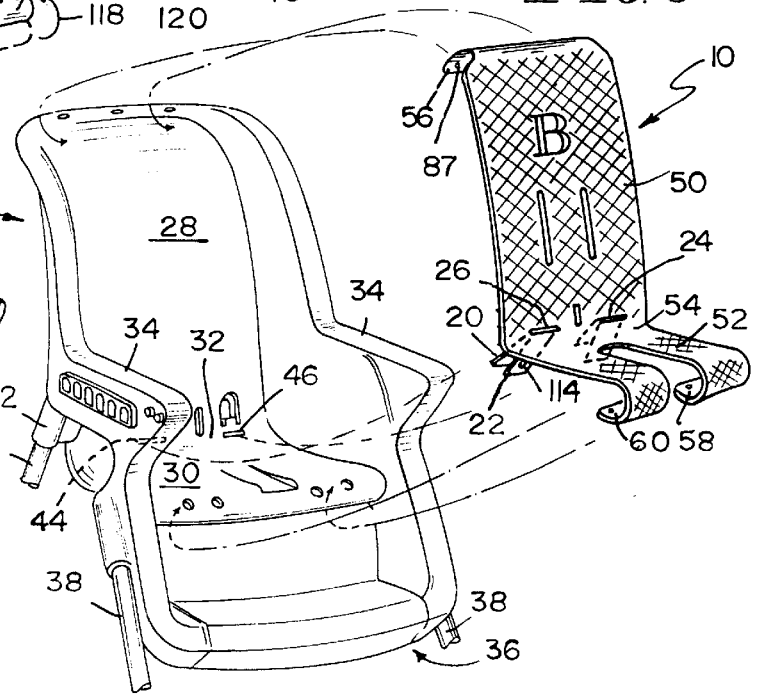
FIG. 9 is a perspective view similar to FIG. 4 showing placement of the reversible seat pad on the seat so that reverse side "B" is visible.

Tether straps 16, 18, 20, 22 are coupled to reversible seat pad 10 as shown, for example, in FIG. 3 and used to tether seat pad 10 to seat 12 when seat pad 10 is mounted on seat 12 in the first position as suggested in FIG. 4 and in the second position as suggested in FIG. 9. The free ends of these tether straps 16, 18, 20, 22 can be passed manually by a user through strap passage slots 24, 26 formed in reversible seat pad 10 as shown, for example, in FIGS. 3 and 13 to enable the user to arrange tether straps 16, 18, 20, 22 to extend rearwardly toward seat 10 when seat pad 10 is arranged in the first position so that side "A" is visible as shown in FIG. 4 and also when seat pad 10 has been rearranged in the second position so that side "B" is visible as shown in FIG. 9.

Figure 2:
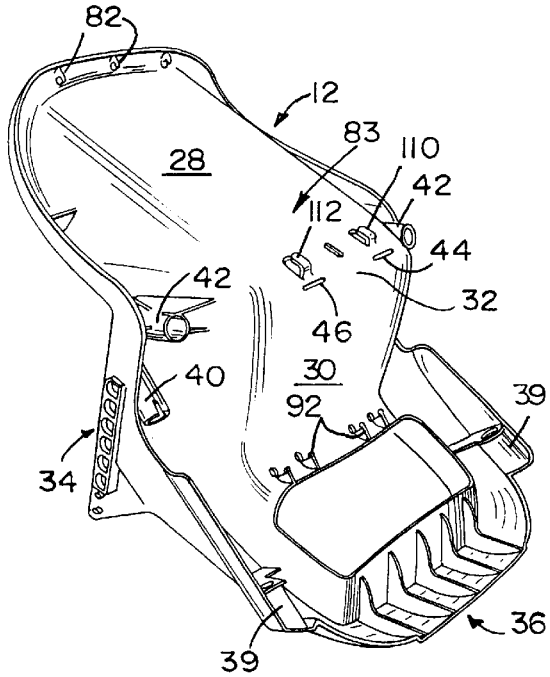
FIG. 2 is a perspective view of a rearward side of the seat shown in FIG. 1 before the reversible seat pad is installed on the seat showing three top pad mounts along a top edge of the seat back, four bottom pad mounts along a bottom edge of the seat bottom, and two tether mounts along a "junction line" between the seat back and seat bottom.
Figure 5:
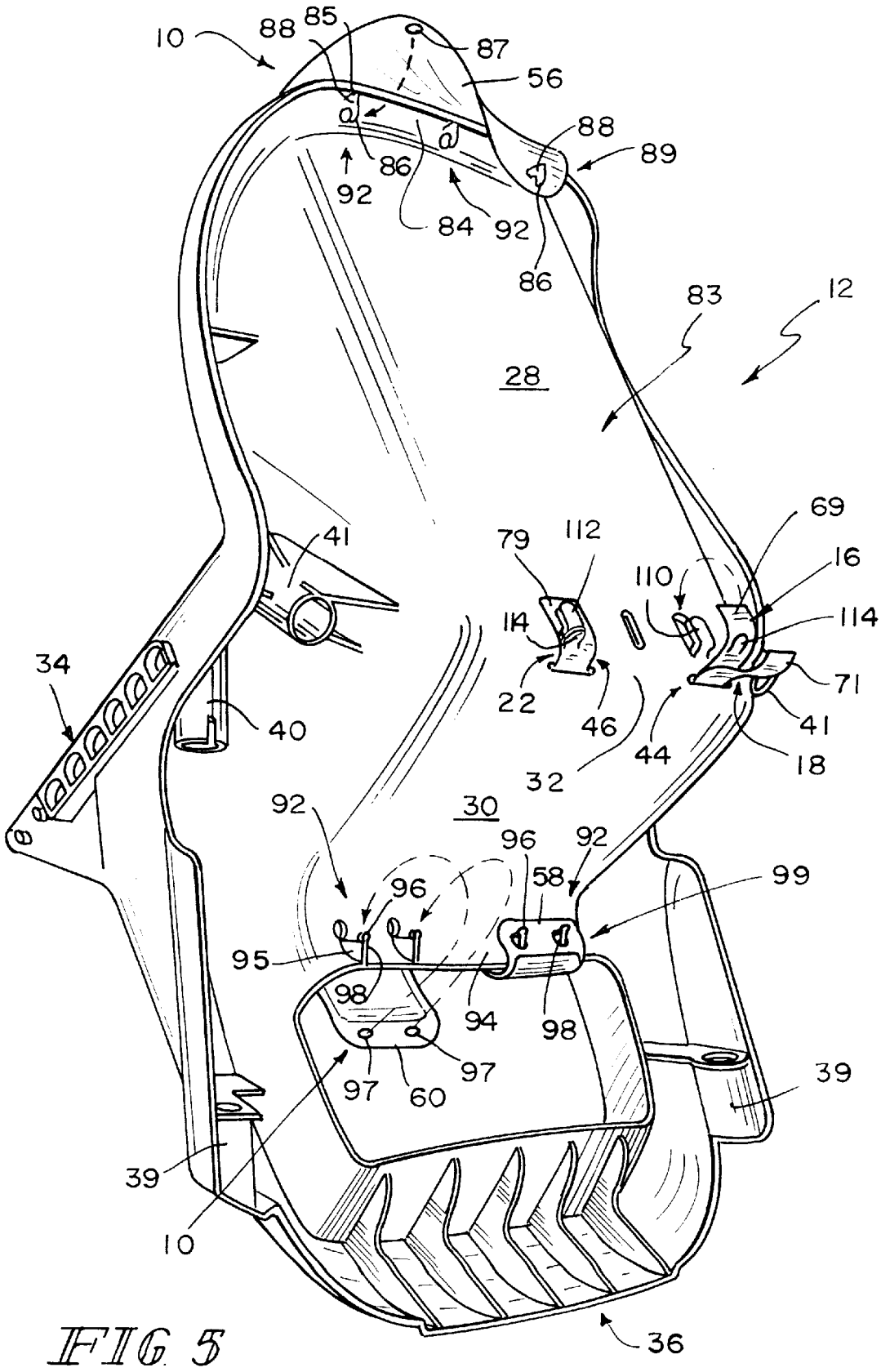
FIG. 5 is an enlarged perspective view similar to FIG. 2 showing how top and bottom connectors (flaps) of the reversible seat pad can be deformed and hooked onto the top and bottom pad mounts provided on the rearward side of the seat.

Referring now to FIGS. 1, 2, and 5, seat 12 includes a seat back 28, seat bottom 30 coupled to seat back 28 along a "junction line" 32, a pair of armrests 34 positioned to lie in laterally spaced-apart relation to one another on opposing sides of seat bottom 30, and a footrest 36 supported to lie below seat bottom 30. Front legs 38 are coupled to sleeves 39 and mounts 40 formed in seat 12 and rear legs 41 are coupled to mounts 42 formed in seat 12. Reference is hereby made to U.S. application Ser. No. 09/092,216, filed on Jun. 5, 1998 for a description of various features of a juvenile seat, which description is incorporated by reference herein.

Seat 12 is formed to include first and second tether slots 44, 46 as shown, for example, in FIGS. 2, 4, 5, and 9. First tether slot 44 is sized to receive a first pair of tether straps 16, 18 therein to enable seat pad 10 to be tethered to seat 12 at one point. Second tether slot 46 is sized to receive a second pair of tether straps 20, 22 therein to enable seat pad 10 to be tethered to seat 12 at another point. First and second tether slots 44, 46 are formed in seat 12 to lie along junction line 32 in spaced-apart relation to one another as shown best in FIG. 5. It is within the scope of this disclosure to position either one or both of slots 44, 46 in seat back 28 or seat bottom 30 away from junction line and/or to merge slots 44, 46 together to form a single slot.

One example of a reversible seat pad in accordance with the present invention is shown in detail in FIG. 3. Seat pad 10 has a first seating side "A" and a second seating side "B." Seat pad 10 also includes a pad back 50, a pad bottom 52 coupled to the pad back 50 at a hinge or fold line 54, a top connector 56 appended to an upper end of the pad back 50, and a pair of bottom connectors 58, 60 appended to lower ends of seat bottom 52 and separated from one another by a crotch-post opening 61. Pad back 50 is also formed to include two vertical hinge lines 62 to facilitate the fitting of pad back 50 onto seat back 28 of seat 12 and a seat belt slot 64 to allow a seat belt (not shown) that is tethered to seat 12 to be passed through seat pad 10 and tightened around the waist of a child seated in seat 12 on seat pad 10.

As shown, for example, in FIG. 3, reversible seat pad 10 includes upper and lower first internal edges 65, 66 that cooperate to define first strap passage slot 24. A fixed end 67 of primary first tether strap 16 is coupled to upper first internal edge 65 and a fixed end 68 of auxiliary first tether strap 18 is coupled to lower first internal edge 66. Coupling fixed ends 67, 68 of tether straps 16, 18 in this way makes it easy for a user to grasp a free end 69 of primary first tether strap 16 and pass it through first strap passage slot 24 after moving it along a path shown by dotted arrow 70. Likewise, a user is able to grasp a free end 71 of auxiliary first tether strap 18 and pass it through the same first strap passage slot 24 after moving it along a path shown by dotted arrow 72.

Figure 13:
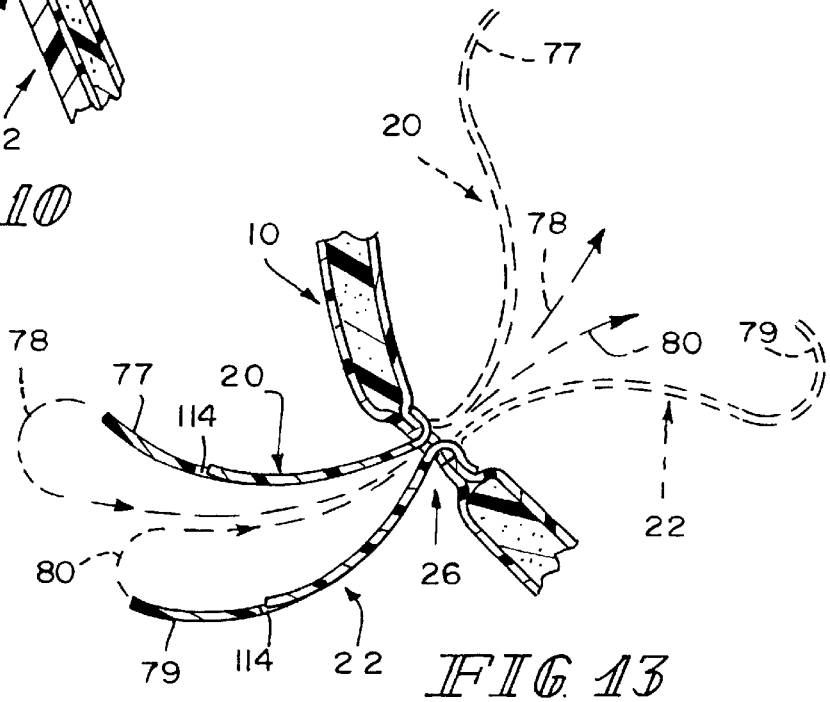
FIG. 13 is a view taken along line 13—13 of FIG. 3 showing how the tether straps of FIG. 12 can move from one side of the reversible seat pad to the other side of the reversible seat pad to prepare the pad to be reversed as shown, for example, in FIGS. 4, 6, 7, and 8.

Reversible seat pad 10 also includes upper and lower second internal edges 73, 74 that cooperate to define second strap passage slot 26 as shown, for example, in FIG. 3. A fixed end 75 of primary second tether strap 20 is coupled to upper second internal edge 73 and a fixed end 76 of auxiliary second tether strap 22 is coupled to lower second internal edge 74. Coupling fixed ends 73, 74 of tether straps 20, 22 in this way makes it easy for a user to grasp a free end 77 of primary second tether strap 20 and pass it through second strap passage slot 26 after moving it along a path shown by dotted arrow 78 as shown in FIGS. 3 and 13. Likewise, a user is able to grasp a free end 79 of auxiliary second tether strap 22 and pass it through the same second strap passage slot 26 after moving it along a path shown by dotted arrow 80 as shown in FIGS. 3 and 13.

Figure 10:
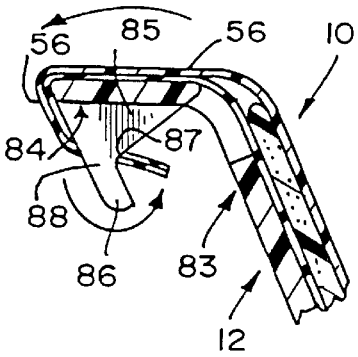
FIG. 10 is a sectional view taken along line 10—10 of FIG. 1 showing how one of the top pad mounts extends through one of the mount-receiver holes formed along a top edge of the seat pad to retain the pad back on the seat.

Referring now to FIGS. 2 and 5, three top pad mounts 82 are coupled to a rearward side 83 of seat 12 along a top edge or rim 84 of seat 12 to facilitate attachment of upper portion 56 of reversible seat pad 10 to seat back 28 of seat 12. Each top pad mount 82 includes a support flange 85 appended to rearward side 83 of seat 12, a retainer ball 86 adapted to pass through one of the mount-receiver holes 87 formed in upper portion 56 of reversible seat pad 10, and a neck 88 arranged to interconnect retainer ball 86 and support flange 85. Once attached (as shown in FIG. 10 and at 89 in FIG. 5), neck 88 of top pad mount 82 lies in one of the mount receiver holes 87 to trap upper portion 56 of reversible seat pad 10 between retainer ball 86 and support flange 85. It is within the scope of this disclosure to use other suitable hooks, pins, claps, grips, inserts, rods, etc. to extend through mount-receiver holes 57 to couple upper portion 56 to seat 12. It is also within the scope of this disclosure to form upper portion 56 to include other catches, grips, slots, channels, etc. to be engaged by top pad mount 82 to couple upper portion 56 to seat 12.

Figure 11:
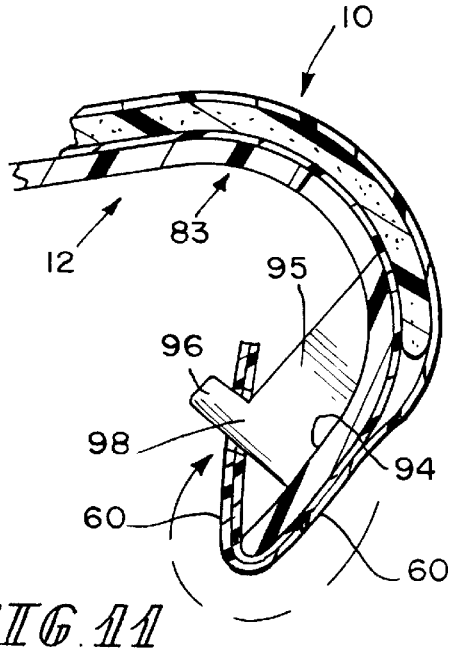
FIG. 11 is a sectional view taken along line 11—11 of FIG. 1 showing how one of the bottom pad mounts extends through one of the mount-receiver holes formed along a bottom edge of the seat pad to retain the pad bottom on the seat.

First and second pairs of bottom pad mounts 92 are coupled to rearward side 83 of seat 12 along a bottom edge or rim 94 of seat 12 as shown, for example, in FIGS. 2, 5, and 11 to facilitate attachment of lower portions 58, 60 of reversible seat pad 10 to seat bottom 30 of seat 12. Each bottom pad mount 92 includes a support flange 95 appended to rearward side 83 of seat 12, a retainer ball 96 adapted to pass through one of the mount-receiver holes 97 formed in lower portions 58, 60 of reversible seat pad 10, and a neck 98 arranged to interconnect retainer ball 96 and support flange 95. Once attached (as shown in FIG. 11 and at 99 in FIG. 5), neck 98 of bottom pad mount 92 lies in one of the mount-receiver holes 97 to trap lower portion 58 or 60 of reversible seat pad 10 between retainer ball 96 and support flange 95. The alternative structures described above in connection with top pad mounts 82 and upper portion 56 also apply to bottom pad mounts 92 and lower portions 58, 60.

Figure 12:
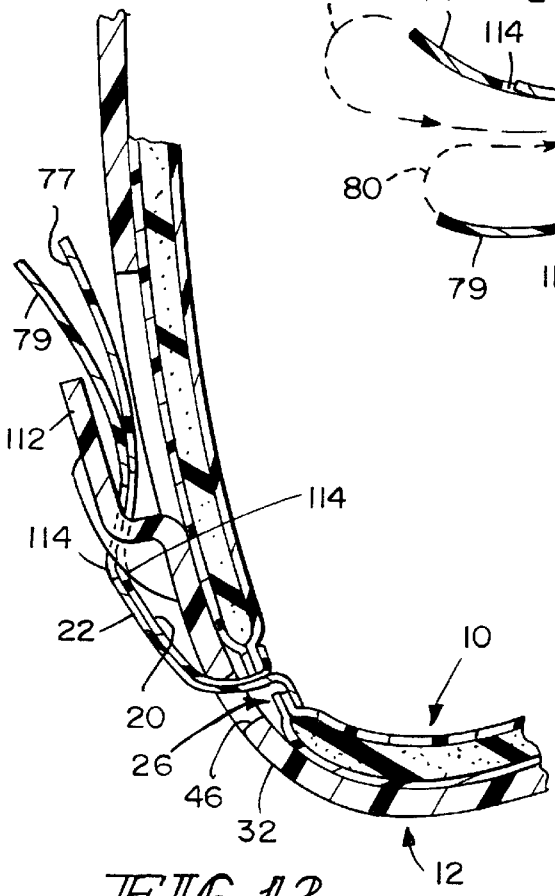
FIG. 12 is a sectional view taken along line 12—12 of FIG. 1 showing how the fee ends of the second set of two tether straps are coupled to a second tether mount provided on the rearward face of the seat to tether a middle portion of the reversible seat pad to the seat.

Tether mounts 11, 112 are provided on rearward side 83 of seat 12 as shown, for example, in FIGS. 2, 5, and 12 to facilitate attachment of tether straps 16, 18, 20, 22 to seat 12. A first tether mount 10 is coupled to seat 12 to lie in close proximity to first tether slot 44 and a second tether mount 112 is coupled to seat 12 to lie in close proximity to second tether slot 46. The free end of each of tether straps 16, 18, 20, 22 is formed to include a hole 114 adapted to receive one of the tether mounts 110 or 112 therein as shown, for example, in FIGS. 5 and 12 to couple a tether strap to a tether mount.

Reversal of seat pad 10 from a first position on seat 12 shown in FIG. 1 and suggested in FIG. 4 to a reversed second position suggested in FIG. 9 is shown, for example, in FIGS. 4–9. First upper portion 56 (i.e., top connector) of seat pad 10 is released from top pad mounts 82, tether straps 16, 18, 20, 22 are unhooked from tether mounts 110, 112 to release a middle portion of seat pad, and lower portions 58, 60 (i.e., bottom connector) of seat pad 10 is released from bottom pad mounts 92 to permit a user to remove seat pad 10 from seat 12 as suggested in FIG. 4. Second, as suggested in FIG. 6, upper portion 56 of seat pad 10 is "rolled" forward in direction 116, each of lower portions 58, 60 is rolled forward in direction 118, and free ends 69, 71, 77, 79 of tether straps 16, 18, 20, 22 are passed through first and second strap passage slots 24, 26 formed along fold line 54 of seat pad 10 to cause the tether straps to lie on the front side "A" of seat pad 10 rather than on the back side "B" of seat 10.

Figure 7:
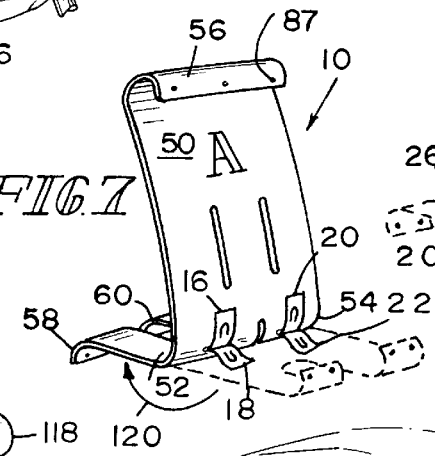
Figure 8:
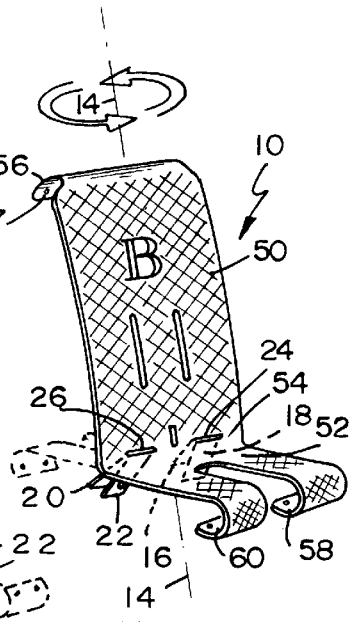

Next, as suggested in FIG. 7, pad bottom 52 is pivoted rearwardly in direction 120 about fold line 54 to assume a "reversed" position (shown in solid in FIG. 7). Fourth, seat pad 10 is rotated about vertical axis 14 as suggested in FIG. 8 and remounted on seat 12 as suggested in FIG. 9.

Although the invention has been described in detail with reference to certain preferred embodiments, variations and modifications exist within the scope and spirit of the invention as described and defined in the following claims.

What is claimed is:

1. A seat unit comprising a seat including a forward side configured to support an individual seated in the seat unit and an opposite rearward side arranged to face away from an individual seated in the seat unit, the seat being formed to include a first tether slot having a front opening in the forward surface and a rear opening in the rearward surface, a reversible seat pad having a first seating side and an opposite second seating side, the seat pad being formed to include a first strap passage slot therein, and a primary first tether strap arranged to extend through the first tether slot formed in the seat, the primary first tether strap including a fixed end coupled to the reversible seat pad and a free end coupled to the seat on the rearward side thereof to cause the first seating side of the reversible seat pad to face toward the forward side of the seat and adapted to be passed through the first strap passage slot formed in the reversible seat pad and the first tether slot formed in the seat and coupled to the seat on the rearward side upon reversal of the reversible seat pad on the seat to present the second seating side of the seat pad toward the forward side of the seat.

2. The seat unit of claim 1, wherein the seat is also formed to include a second tether slot positioned to lie in spaced-apart relation to the first tether slot, the reversible seat pad is formed to include a second strap passage slot positioned to lie in spaced-apart relation to the first strap passage slot, and further comprising a primary second tether strap extending through the second tether slot and including a fixed end coupled to the reversible seat pad and a free end coupled to the seat on the rearward side thereof and adapted to be passed through the second strap passage slot formed in the reversible seat pad and coupled to the seat on the rearward side upon reversal of the reversible seat pad to present the second seating side of the reversible seat pad toward the forward side of the seat.

3. The seat unit of claim 2, wherein the reversible seat pad includes a pad back and a pad bottom coupled to the pad back, a top connector appended to an upper end of the pad back and formed to include a top mount-receiver hole, and a bottom connector appended to a lower end of the pad bottom and formed to include a bottom mount-receiver hole, and the seat includes a top pad mount coupled to the rearward side and arranged to extend through the top mount-receiver hole to cooperate with the first and second tether straps to retain the pad back in a fixed position on the forward side of the seat and a bottom pad mount coupled to the rearward side and arranged to extend through the bottom mount-receiver hole to cooperate with the first and second tether straps to retain the pad bottom in a fixed position on the forward side of the seat.

4. The seat unit of claim 3, wherein the top pad mount includes a top support flange appended to the rearward side of the seat, a top retainer ball adapted to pass through the top mount-receiver hole, and a top neck arranged to interconnect the top retainer ball and the top support flange and lie in the top mount-receiver hole to trap the top connector between the top retainer ball and the top support flange and the bottom pad mount includes a bottom support flange appended to the rearward side of the seat, a bottom retainer ball adapted to pass through the bottom mount-receiver hole, and a bottom neck arranged to interconnect the bottom retainer ball and the bottom support flange and lie in the bottom mount-receiver hole to trap the bottom connector between the bottom retainer ball and the bottom support flange.

5. The seat unit of claim 2, wherein the seat includes a first tether mount coupled to the rearward side and arranged to lie in close proximity to the first tether slot and a second tether mount coupled to the rearward side and arranged to lie in close proximity to the second tether slot, the free end of the primary first tether strap is coupled to the first tether mount, and the free end of the primary second tether strap is coupled to the second tether mount.

6. The seat unit of claim 5, wherein the free end of each tether strap is formed to include a hole therein, the first tether mount extends through the hole formed in the free end of the primary first tether strap, and the second tether mount extends through the hole formed in the free end of the primary second tether strap.

7. The seat unit of claim 1, further comprising an auxiliary tether strap extending through the first tether slot and including a fixed end coupled to the reversible seat pad and a free end coupled to the seat on the rearward side thereof and adapted to be passed through the first strap passage slot formed in the reversible seat pad and coupled to the seat on the rearward side upon reversal of the reversible seat pad on the seat to present the second seating side of the reversible seat pad toward the forward side of the seat.

8. The seat unit of claim 7, wherein the reversible seat pad includes upper and lower first internal edges that cooperate to define the first strap passage slot, the fixed end of the primary first tether is coupled to the upper first internal edge of the reversible seat pad, and the fixed end of the auxiliary first tether is coupled to the lower first internal edge of the reversible seat pad.

9. The seat unit of claim 7, wherein the primary first tether strap and the auxiliary first tether strap lie in side-by-side relation to one another when the free ends of the first tether straps are coupled to the seat on the rearward side thereof.

10. The seat unit of claim 7, wherein the reversible seat pad includes a pad back and a pad bottom appended to the pad back along a hinge line and the reversible seat pad is formed to position the first strap passage slot to lie along the hinge line.

11. The seat pad of claim 10, wherein the reversible seat pad further includes a top connector appended to an upper end of the pad back and positioned to lie in spaced-apart relation to the hinge line, the top connector is formed to include a mount-receiver hole, and the seat further includes a pad mount coupled to the rearward side and arranged to extend through the mount-receiver hole to retain the pad back in a fixed position on the forward side of the seat.

12. The seat pad of claim 10, wherein the reversible seat pad further includes a bottom connector appended to a lower end of the pad bottom and positioned to lie in spaced-apart relation to the hinge line, the bottom connector is formed to include a mount-receiver hole, and the seat further includes a pad mount coupled to the rearward side and arranged to extend through the mount-receiver hole to retain the pad bottom in a fixed position on the forward side of the seat.

13. The seat unit of claim 7, wherein the seat is also formed to include a second tether slot positioned to lie in spaced-apart relation to the first tether slot and the reversible seat pad is formed to include a second strap passage slot therein, and further comprising primary and auxiliary second tether straps, each second tether strap extending through the second tether slot and including a fixed end coupled to the reversible seat pad and a free end coupled to the seat on the rearward side thereof and adapted to be passed through the second strap passage slot formed in the reversible seat pad and coupled to the seat on the rearward side upon reversal of the reversible seat pad to present the second seating side of the reversible seat pad toward the forward side of the seat.

14. The seat unit of claim 13, wherein the reversible seat pad includes upper and lower second internal edges that cooperate to define the second strap passage slot, the fixed end of the primary second tether is coupled to the upper second internal edge of the reversible seat pad, and the fixed end of the auxiliary second tether is coupled to the lower second internal edge of the reversible seat pad.

15. The seat unit of claim 13, wherein the primary second tether strap and the auxiliary second tether strap lie in side-by-side relation to one another when the free ends of the second tether straps are coupled to the seat on the rearward side thereof.

16. The seat unit of claim 1, wherein the reversible seat pad includes a pad back and a pad bottom coupled to the pad back along a hinge line, one face of each of the pad back and pad bottom cooperate to define the first seating side of the reversible seat pad, another face of each of the pad back and pad bottom cooperate to define the second seating side of the reversible seat pad, and the reversible seat pad is formed to position the first strap passage slot to lie along the hinge line.

17. The seat unit of claim 16, wherein the reversible seat pad further includes a top connector appended to an upper end of the pad back and positioned to lie in spaced-apart relating to the hinge line, the top connector is formed to include a mount-receiver hole, and the seat farther includes a pad mount coupled to the rearward side and arranged to extend through the mount-receiver hole to retain the pad back in a fixed position on the forward side of the seat.

18. The seat unit of claim 17, wherein the pad mount includes a support flange appended to the rearward side of the seat, a retainer ball adapted to pass through the mount-receiver hole, and a neck arranged to interconnect the retainer ball and the support flange and lie in the mount-receiver hole to trap the top connector between the retainer ball and the support flange.

19. The seat pad of claim 16, wherein the reversible seat pad further includes a bottom connector appended to a lower end of the pad bottom and positioned to lie in spaced-apart relation to the hinge line, the bottom connector is formed to include a mount-receiver hole, and the seat further includes a pad mount coupled to the rearward side and arranged to extend through the mount-receiver hole to retain the pad bottom in a fixed position on the forward side of the seat.

20. The seat pad of claim 19, wherein the pad mount includes a support flange appended to the rearward side of the seat, a retainer ball adapted to pass through the mount-receiver hole, and a neck arranged to interconnect the retainer ball and the support flange and lie in the mount-receiver hole to trap the bottom connector between the retainer ball and the support flange.

21. The seat unit of claim 18, wherein the reversible seat pad further includes a bottom connector appended to a lower end of the pad bottom and positioned to lie in spaced-apart relation to the hinge line, the bottom connector is formed to include a bottom mount-receiver hole, the seat further includes a bottom pad mount coupled to the rearward side and arranged to extend through the bottom mount-receiver hole to retain the pad bottom in a fixed position on the forward side of the seat, the bottom pad mount includes a bottom support flange appended to the rearward side of the seat, a bottom retainer ball adapted to pass through the bottom mount-receiver hole, and a bottom neck arranged to interconnect the bottom retainer ball and the bottom support flange and lie in the bottom mount-receiver hole to trap the bottom connector between the bottom retainer ball and the bottom support flange, the reversible seat pad further includes a top connector appended to an upper end of the pad back and positioned to lie in spaced-apart relation to the hinge line, the top connector is formed to include a top mount-receiver hole, the seat further includes a top pad mount coupled to the rearward side and arranged to extend through the top mount-receiver hole to retain the pad back in a fixed position on the forward side of the seat, and the top pad mount includes a top support flange appended to a rearward side of the seat, a top retainer ball adapted to pass through the top mount-receiver hole, and a top neck arranged to interconnect the top retainer ball and the top support flange and lie in the top mount-receiver hole to trap the top connector between the top retainer ball and the top support flange.

22. A seat unit comprising a seat including a pad-receiving surface and being formed to include a first tether slot having a front opening in the pad-receiving surface, a reversible seat pad having a first seating side and an opposite second seating side, the reversible seat pad being movable relative to the seat between a first position wherein the second seating side faces toward the pad-receiving surface and the first seating side faces away from the pad-receiving surface to permit a seat occupant to sit thereon and a second position wherein the first seating side faces toward the pad-receiving surface and the second seating side faces away from the pad-receiving surface to permit a seat occupant to sit thereon, the reversible seat pad including a first interior edge defining a first strap passage slot having one opening in the first seating side and an opposite opening in the second seating side, and a primary first tether strap arranged to extend through the first tether slot formed in the seat, the primary first tether strap including a fixed end coupled to the first interior edge of the reversible seat pad and a free end coupled to the seat to tether the reversible seat pad to the seat upon placement of the reversible seat pad in the first position on the seat and in the second position on the seat.

23. The seat unit of claim 22, further comprising an auxiliary first tether strap arranged to extend through the first tether slot formed in the seat and lie alongside the primary first tether strap, the auxiliary first tether strap including a fixed end coupled to the first interior edge of the reversible seat pad and a free end coupled to the seat upon placement of the reversible seat pad in the first position on the seat and in the second position on the seat.

24. The seat unit of claim 22, wherein the seat is also formed to include a second tether slot having a front opening in the pad-receiving surface, the reversible seat pad further includes a second interior edge defining a second strap passage slot having one opening in the first side of the seat and an opposite opening in the second side of the seat, and further comprising a primary second tether strap arranged to extend through the second tether slot formed in the seat, the primary second tether strap including a fixed end coupled to the second interior edge of the reversible seat pad and a free end coupled to the seat to tether the reversible seat pad to the seat upon placement of the reversible seat pad in the first position on the seat and in the second position on the seat.

25. The seat unit of claim 24, wherein the seat includes a first tether mount coupled to the rearward side and arranged to lie in close proximity to the first tether slot and a second tether mount coupled to the rearward side and arranged to lie in close proximity to the second tether slot, the free end of the primary first tether strap is coupled to the first tether mount, and the free end of the primary second tether strap is coupled to the second tether mount.

26. The seat unit of claim 25, wherein the free end of each tether strap is formed to include a hole therein, the first tether mount extends through the hole formed in the free end of the primary first tether strap, and the second tether mount extends through the hole formed in the free end of the primary second tether strap.

27. The seat unit of claim 24, furher comprising an auxiliary first tether strap arranged to extend through the first tether slot formed in the seat and lie alongside the primary first tether strap, the auxiliary first tether strap including a fixed end coupled to the first interior edge of the reversible seat pad and a free end coupled to the seat upon placement of the reversible seat pad in the first position on the seat and in the second position on the seat, and an auxiliary second tether strap arranged to extend through the second tether slot formed in the seat and lie alongside the primary second tether strap, the auxiliary second tether strap including a fixed end coupled to the second interior edge of the reversible seat pad and a free end coupled to the seat upon placement of the reversible seat pad in the first position on the seat and in the second position on the seat.

28. The seat unit of claim 24, wherein the reversible seat pad includes a pad back and a pad bottom coupled to the pad back, a top connector appended to an upper end of the pad back and formed to include a top mount-receiver hole, and a bottom connector appended to a lower end of the pad bottom and formed to include a bottom mount-receiver hole, and the seat includes a top pad mount coupled to the rearward side and arranged to extend through the top mount-receiver hole to cooperate with the first and second tether straps to retain the pad back in a fixed position on the forward side of the seat and a bottom pad mount coupled to the rearward side and arranged to extend through the bottom mount-receiver hole to cooperate with the first and second tether straps to retain the pad bottom in a fixed position on the forward side of the seat.

29. The seat unit of claim 28, wherein the top pad mount includes a top support flange appended to the rearward side of the seat, a top retainer ball adapted to pass through the top mount-receiver hole, and a top neck arranged to interconnect the top retainer ball and the top support flange and lie in the top mount-receiver hole to trap the top connector between the top retainer ball and the top support flange and the bottom pad mount includes a bottom support flange appended to the rearward side of the seat, a bottom retainer ball adapted to pass through the bottom mount-receiver hole, and a bottom neck arranged to interconnect the bottom retainer ball and the bottom support flange and lie in the bottom mount-receiver hole to trap the bottom connector between the bottom retainer ball and the bottom support flange.

30. A seat unit comprising a seat including a seat back having a top edge and a bottom edge and a seat bottom having a back edge coupled to the bottom edge of the seat back, a front edge positioned to lie in spaced-apart relation to the back edge, a left side edge extending from the back edge to the front edge, and a right side edge extending from the back edge to the front edge, the seat back and seat bottom cooperating to define a forward side of the seat configured to support an individual seated in the seat unit and an opposite rearward side arranged to face away from an individual seated in the seat unit, the seat further including a left side wall extending upwardly from the left side edge and a right side wall extending upwardly from the right side edge in spaced apart relation to the left side wall so that the left and right side walls provide arm rests on either side of the seat bottom, a top pad mount coupled to the rearward side of the seat along the top edge of the seat back, a bottom pad mount coupled to the rearward side of the seat along the front edge of the seat bottom and in spaced apart relation to the left and right side walls, a first tether mount coupled to the seat, a primary first tether strap adapted to be coupled to the first tether mount on the seat, and a reversible seat pad having a first seating side and an opposite second seating side, the reversible seat pad being formed to include a top mount-receiver hole and a bottom mount-receiver hole, the primary first tether strap including a fixed end coupled to the reversible seat pad and a free end adapted to be coupled to the first tether mount, the reversible seat pad being movable relative to the seat between a first position wherein the second seating side faces toward the pad-receiving surface, the first seating side faces away from the pad-receiving surface to permit a seat occupant to sit thereon, the top pad mount extends through the top mount-receiver hole, the bottom pad mount extends through the bottom mount-receiver hole, and the primary first tether strap is coupled to the first tether mount to retain the reversible seat pad on the seat in the first position and a second position wherein the first seating side faces toward the pad-receiving surface, the second seating side faces away from the pad-receiving surface to permit a seat occupant to sit thereon, the top pad mount extends through the top mount-receiver hole, the bottom pad mount extends through the bottom mount-receiver hole, and the primary first tether strap is coupled to the first tether mount to retain the reversible seat pad on the seat in the second position.

31. The seat unit of claim 30, wherein the first tether mount is coupled to the rearward face of the seat.

32. The seat unit of claim 30, wherein the top pad mount includes a top support flange appended to the rearward side of the seat, a top retainer ball adapted to pass through the top mount-receiver hole, and a top neck arranged to interconnect the top retainer ball and the top support flange and lie in the top mount-receiver hole to trap a portion of the reversible seat pad between the top retainer ball and the top support flange.

33. The seat unit of claim 30, wherein the top pad mount includes a bottom support flange appended to the rearward side of the seat, a bottom retainer ball adapted to pass through the bottom mount-receiver hole, and a bottom neck arranged to interconnect the bottom retainer ball and the bottom support flange and lie in the bottom mount-receiver hole to trap a portion of the reversible seat pad between the bottom retainer ball and the bottom support flange.

34. A seat unit comprising a seat including a seat back having a top edge and a bottom edge and a seat bottom having a back edge coupled to the bottom edge of the seat back and a front edge positioned to lie in spaced-apart relation to the back edge, the seat back and seat bottom cooperating to define a forward side of the seat configured to support an individual seated in the seat unit and an opposite rearward side arranged to face away from an individual seated in the seat unit, a top pad mount coupled to the rearward side of the seat along the top edge of the seat back, a bottom pad mount coupled to the rearward side of the seat along the front edge of the seat bottom, a first tether mount coupled to the seat, a primary first tether strap adapted to be coupled to the first tether mount on the seat, and a reversible seat pad having a first seating side and an opposite second seating side, the reversible seat pad being formed to include a top mount-receiver hole and a bottom mount-receiver hole, the primary first tether strap including a fixed end coupled to the reversible seat pad and a free end adapted to be coupled to the first tether mount, the reversible seat pad being movable relative to the seat between a first position wherein the second seating side faces toward the pad-receiving surface, the first seating side faces away from the pad-receiving surface to permit a seat occupant to sit thereon, the top pad mount extends through the top mount-receiver hole, the bottom pad mount extends through the bottom mount-receiver hole, and the primary first tether strap is coupled to the first tether mount to retain the reversible seat pad on the seat in the first position and a second position wherein the first seating side faces toward the pad-receiving surface, the second seating side faces away from the pad-receiving surface to permit a seat occupant to sit thereon, the top pad mount extends through the top mount-receiver hole, the bottom pad mount extends through the bottom mount-receiver hole, and the primary first tether strap is coupled to the first tether mount to retain the reversible seat pad on the seat in the second position, the first tether mount being coupled to the rearward face of the seat, the seat being formed to include a first tether slot having a front opening in the forward surface and a rear opening in the rearward surface, the primary first tether strap being positioned to extend through the first tether slot.

35. The seat unit of claim 34, wherein the seat back is coupled to the seat bottom at a junction line and the seat is formed to position the first tether slot at the junction line.

36. The seat unit of claim 34, wherein the seat is formed to include a second tether slot being positioned to lie in spaced-apart relation to the first tether slot and having a front opening in the forward surface and a rear opening in the rearward surface and further comprising a second tether mount coupled to the rearward face of the seat and a primary second tether strap extending through the second tether slot and including a fixed end coupled to the reversible seat pad and a free end coupled to the second tether mount.

37. The seat unit of claim 36, wherein the seat back is coupled to the seat bottom at a junction line and the seat is formed to position the first and second tether slots at the junction line.

38. A seat unit comprising a seat including a seat back having a top edge and a bottom edge and a seat bottom having a back edge coupled to the bottom edge of the seat back and a front edge positioned to lie in spaced-apart relation to the back edge, the seat back and seat bottom cooperating to define a forward side of the seat configured to support an individual seated in the seat unit and an opposite rearward side arranged to face away from an individual seated in the seat unit, a top pad mount coupled to the rearward side of the seat along the top edge of the seat back, a bottom pad mount coupled to the rearward side of the seat along the front edge of the seat bottom, a first tether mount coupled to the seat, a primary first tether strap adapted to be coupled to the first tether mount on the seat, and a reversible seat pad having a first seating side and an opposite second seating side, the reversible seat pad being formed to include a top mount-receiver hole and a bottom mount-receiver hole, the primary first tether strap including a fixed end coupled to the reversible seat pad and a free end adapted to be coupled to the first tether mount, the reversible seat pad being movable relative to the seat between a first position wherein the second seating side faces toward the pad-receiving surface, the first seating side faces away from the pad-receiving surface to permit a seat occupant to sit thereon, the top pad mount extends through the top mount-receiver hole, the bottom pad mount extends through the bottom mount-receiver hole, and the prime first tether strap is coupled to the first tether mount to retain the reversible seat pad on the seat in the first position and a second position wherein the first seating side faces toward the pad-receiving surface, the second seating side faces away from the pad-receiving surface to permit a seat occupant to sit thereon, the top pad mount extends through the top mount-receiver hole, the bottom pad mount extends through the bottom mount-receiver hole, and the primary first tether strap is coupled to the first tether mount to retain the reversible seat pad on the seat in the second position, and an auxiliary tether strap extending through a first tether slot formed in the seat and including a fixed end coupled to the reversible seat pad and a free end coupled to the first tether mount.

39. The seat unit of claim 38, wherein the reversible seat pad is formed to include a first strap passage slot therein and the free end of each of the primary and auxiliary tether straps is adapted to be passed through the first strap passage slot formed in the reversible seat pad.

40. The seat unit of claim 39, wherein the reversible seat pad includes a pad back and a pad bottom appended to the pad back along a hinge line and the reversible seat pad is formed to position the first strap passage slot to lie along the hinge line.

41. The seat unit of claim 39, wherein the reversible seat pad is formed to position the first strap passage slot in opposing confronting relation to the first tether slot formed in the seat.

* * * * *